United States Patent [19]

Doherty, Jr.

[11] Patent Number: 4,514,717

[45] Date of Patent: Apr. 30, 1985

[54] SINGLE TERMINAL SNAP ACTING THERMAL SWITCH

[75] Inventor: John Doherty, Jr., Assonet, Mass.

[73] Assignee: Texas Instruments Incorporated, Dallas, Tex.

[21] Appl. No.: 555,246

[22] Filed: Nov. 25, 1983

[51] Int. Cl.[3] ..... H01H 37/54

[52] U.S. Cl. ..... 337/365; 337/380

[58] Field of Search ..... 337/380, 381, 365, 349, 337/343, 112

[56] References Cited

U.S. PATENT DOCUMENTS 4,282,505 8/1981 Place ..... 337/365

*Primary Examiner*—Harold Broome

*Attorney, Agent, or Firm*—John A. Haug; James P. McAndrews; Melvin Sharp

[57] ABSTRACT

An externally threaded grounded metal housing mounting a snap acting disc at a closed end is shown to receive an electrically insulative body mounting an "L" shaped movable contact member having an upstanding leg biased into contact with the internal surface of the housing wall and a laterally extending movable contact leg with a tongue cut and bent out from the leg and engageable with the snap acting disc. A terminal is pushed into a slot of the body and mounts at its free distal end a stationary contact. The mounting surface for the movable contact member is skewed relative to the lid terminal slot in order to obtain a longer effective movable contact arm.

8 Claims, 5 Drawing Figures

SINGLE TERMINAL SNAP ACTING THERMAL SWITCH

BACKGROUND OF THE INVENTION

The present invention relates generally to thermally responsive snap acting switches and more specifically to such switches particularly useful with automotive motors and components therefor.

In recent years there has been a trend to continually reduce the size and weight of automotive vehicles to make them more fuel efficient as well as to minimize the overall price of the vehicles to make them affordable to a greater number of consumers. In this regard the size of and accessibility to many of the components used in such vehicles have also been reduced and since it is common to mount thermal switches in heat transfer relation with such components, it has become necessary to reduce the size of these switches since there is less available space for them. Such components include various electrical loads such as cooling fan control relays, solenoids, warning lights and the like, typically in the order of 300–400 milliamperes, 14 volt DC. Snap acting thermally responsive switches are used with many of these electrical loads and as the physical size of the switches is decreased, the longevity of the switches has been adversely affected due, inter alia, to increases in stress levels in the shortened movable parts of the switches.

SUMMARY OF THE INVENTION

It is an object of the invention to provide a snap acting, thermally responsive device in a smaller physical package than is available in the prior art suitable for switching such loads. Another object is the provision of a single terminal, grounded case switch which is readily mounted in automotive engine environments. Yet another objective is the provision of a snap acting switch having a cylindrical housing of a minimal diameter and having an external male threaded portion for direct mounting in bores of a heat source to be controlled, which switch has improved low stress levels in its movable contact arm assembly for enhanced longevity. Other objects and features will be in part apparent and in part pointed out hereinafter.

Briefly, in accordance with the invention an elongated body of molded electrically insulative material, such as a thermoplastic is received in a thermally and electrically conductive, externally threaded cylindrical housing adapted to be screwed into a threaded bore in the housing of a heat source or electric load to be controlled. The housing has a closed end which seats a snap acting disc. The body has a free distal end which, when inserted in the housing is spaced a selected distance from the closed end to form a switch cavity. A flat, movable contact member seating surface is formed on the outer periphery of the body and extends longitudinally along the major portion of the length of the body received in the housing. A thin generally "L" shaped movable contact member is formed with an upstanding leg received on the seating surface and a transversely extending leg which extends essentially across the whole diameter of the circular switch cavity section and mounts a movable contact at its distal free end. The transversely extending leg has a tongue struck out intermediate its free and attached ends adapted to engage the center of the snap acting disc. The distal end of the upstanding leg is formed with a generally "V" shaped portion adapted to be biased against the housing wall to form an electrical connection therewith. The upstanding leg of the movable contact member is secured to the seating surface a selected distance from the transversely extending leg in order to maximize the length of the movable portion of the leg to reduce stress levels in the leg and lower the spring constant.

An elongated terminal member has a preselected location relative to the hexagonal mounting portion of the housing which is offset from the center of the cylindrical housing and is press fitted into a slot which extends longitudinally between the ends of the body but is skewed relative to the flat seating surface in order to locate the stationary contact member mounted in the distal free end of the terminal diametrically opposed to the flat seating surface and thereby maximize the length of the movable contact member.

The switch may be calibrated by screwing the housing into a bore of a controlled heat block, stabilizing the temperature to a selected level with the disc in the upward convex configuration, pushing the terminal into the switch body until electrical continuity is established, advancing the terminal an additional amount to take up any creep movement and finally locking the terminal in that location with the application of a controlled amount of suitable adhesive or epoxy.

BRIEF DESCRIPTION OF THE DRAWINGS

Various other objects, features and attendant advantages of the present invention will be more fully appreciated as the same become better understood by reference to the following detailed description when considered in connection with the accompanying drawings wherein like reference characters designate like or corresponding parts throughout the several views, and wherein.

DESCRIPTION OF THE PREFERRED EMBODIMENT

Figure 1:
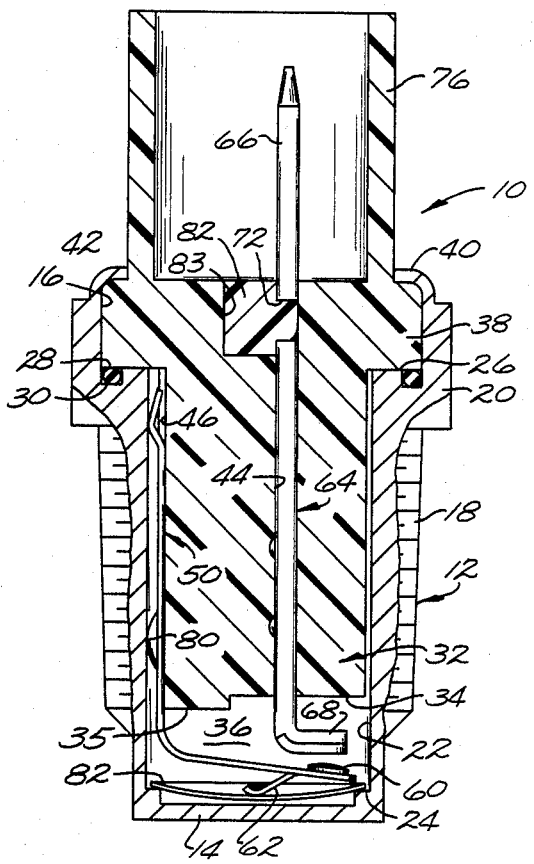
FIG. 1 is a cross sectional view of a switch made in accordance with the invention, the section taken through the body portion of the switch indicated by line 1—1 of FIG. 2.

Referring to FIG. 1 of the drawings numeral 10 refers generally to a thermal switch made in accordance with the invention and is shown to include a housing 12 of thermally and electrically conductive material such as brass configured generally as a hollow cylinder with a first closed end 14 and a second open end 16. The outer surface of housing 12 is preferably threaded and a hexagonal section 20 is formed adjacent the open end to facilitate mounting of switch 10 in a selected threaded bore in the housing of an electric load to be controlled by the switch. Housing 12 has a cylindrical inner wall 22 and is formed with an annular disc seat 24 adjacent the closed end of the housing and a body receiving shoulder 26 and an annular groove 28 near the open end of the housing. An "O" ring 30 of suitable rubber or rubber like material is received in groove 28 to seal the switch from the outer environment.

Figure 2:
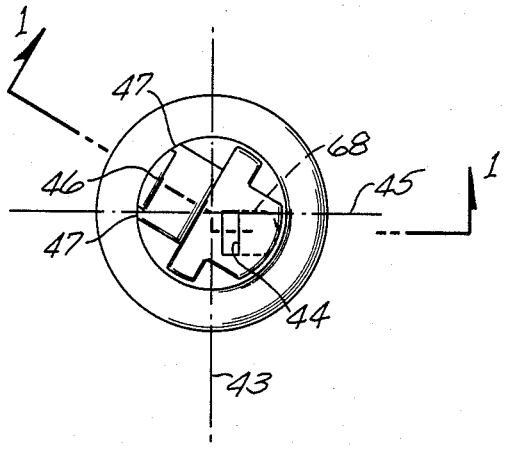
FIG. 2 is a bottom plan view of the body portion of the switch.

An elongated body 32 formed of electrically insulative material such as thermoplastic and having a longitudinal axis generally coincident with the longitudinal axis of housing 12 is received within cylindrical wall 22 and has a first end 34 spaced a selected distance from the closed end 14 of housing 12 to form a switch cavity 36. An outwardly extending, radial flange 38 is formed on body 32 intermediate its ends and is received on shoulder 26 to close open end 16 of the housing. Housing 12 is provided with a thin lip portion 40 at its open end which is turned inwardly onto a shoulder 42 of body 32 after the body is inserted therein to securely lock the body in place. Body 32 is provided with a terminal receiving slot 44, generally rectangular in cross section, which extends parallel to the longitudinal axis and a generally flat, movable contact member seating surface 46 on the outer periphery of body 32 between longitudinally extending ribs 47, with surface 46 lying in a plane parallel to the longitudinal axis. Surface 46 extends essentially the full length of that portion of body 32 received within cylindrical wall section 22. As seen in FIG. 2, surface 46 is skewed relative to slot 44 for a purpose to be described below.

A generally "L" shaped movable contact member 50 of electrically conductive material having good spring characteristics, such as beryllium copper has a first relatively long, upstanding leg portion 52 and a second transversely extending, leg portion 54. The distal free end of leg portion 52 is permanently bent out of the plane of the remainder of leg portion 52 into a generally "V" shape to form converging abutment surfaces 55, 56. An aperture 58 is formed through leg portion 52 adjacent its lower end. Leg portion 54 is provided with an electrical contact 60 of suitable contact material, such as silver or silver alloy, mounted at its distal free end and has a tongue 62 cut and bent out from leg portion 54. Tongue 62 is formed with a spherically shaped free end portion and extends downwardly from portion 54 intermediate the ends thereof.

Figure 5:
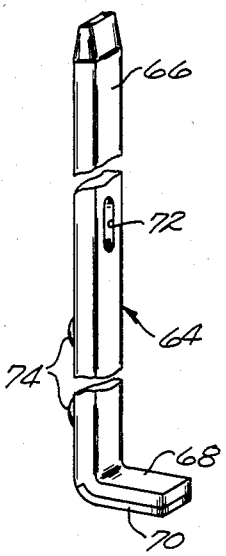
FIG. 5 is a perspective view of the terminal member shown in FIG. 1.

A combination terminal and stationary contact member 64 formed of electrically conductive but relatively stiff material such as brass is generally rectangular in cross section of a size to fit snugly in slot 44 of body 32. Member 64 has a first end 66 formed into a blade terminal and a second end 68 bent at a generally right angle to the remainder of member 64 to serve as a stationary contact support. A conventional contact button can be provided on the lower surface of end 68 or, as seen in FIGS. 1 and 5 an inlaid strip 70 of highly conductive material such as silver or a silver alloy, can be metallurgically bonded to end 68. A locking aperture 72 is formed through member 64 near the terminal portion and preferably a pair of protrusions 74 are formed on member 64 near end 68 to render the fit within slot 44 even more snug.

Figure 3:
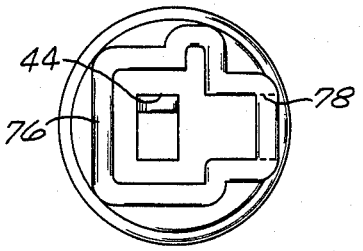
FIG. 3 is a top plan view of the body portion.

Body 32 is also provided with an upstanding wall portion 76 to enclose terminal blade 66. Wall portion 76 is provided with a window 78 (see FIG. 3) to accommodate a latching connector member (not shown).

In preparing to assemble the switch terminal member 64 is inserted in slot 44 and movable contact member 50 is placed on seating surface 46 with a screw 80 inserted through aperture 58 and driven into body member 32 to securely attach movable contact member 50 thereto and complete the subassembly.

In assembling the switch a thermostatic snap acting disc 82 is received in the closed end of housing 12 so that it rests on annular shoulder 24. For a normally open switch adapted to close on increasing temperature when a selected temperature is sensed by the disc the disc will be as shown in FIG. 1, concave at temperatures below the selected and reset temperature.

"O" ring 30 is placed in groove 28 and body 32 is then inserted into housing 12 with the "V" shaped converging surfaces 55, 56 of movable contact arm 50 biased against wall 22. Lip portion 40 is turned onto shoulder 42 to secure body 32 to housing 12.

Calibration of switch 10 may then be accomplished by inserting housing 12 into a heater block and stabilizing it to a selected temperature. Terminal member 64 is pushed into cavity 36 until electrical continuity between the terminal and housing 12 is established. Preferably the terminal is pushed in an additional distance, in the order of 0.010" to take up any creep movement. Finally the terminal member 64 is locked and sealed in place by inserting suitable epoxy 82 into recess 83 of body 32. Epoxy 82 extends into aperture 72 of member 64 to fix its position to body 32.

For a normally closed switch calibration can be effected in the same manner without the heating step.

The particular configuration of wall 76 and location of terminal blade 66 relative to wall 76 is predetermined based on considerations not germane to the internal switch structure. However, in order to maximize the effective, movable length of leg 54 to thereby minimize stress levels in the leg and obtain a suitably low spring constant, movable contact member seating surface 46 is skewed relative to slot 44 so that stationary contact member 70, mounted on the end of terminal 64 can be located diametrically opposed to the movable contact member seating surface. Thus slot 44 longitudinally extending between opposite ends of body 32 has a width substantially greater than its thickness, the width being parallel to axis 43 and the greater part of the slot being disposed on one side of axis 45, which axis forms a 90° angle with axis 43. The greater part of the movable contact member seating surface is on the other side of axis 45. End 68 of terminal member 64 is formed with a 90° bend which serves as the stationary contact member and is skewed relative to surface 46. That is, it extends laterally toward housing side wall 22 and away from the seating surface 46 at an angle of approximately 21°–25°.

As noted above, body 32 extends into the cylindrical housing 12 terminating a selected distance from closed end 14 of the housing to form switch cavity 36. Movable contact member seating surface 46 extends longitudinally over the major portion of the length of the body portion received in housing 12 and terminates at a platform 35 formed on end 34. Platform 35 helps to limit lateral motion of leg 54 while maximizing the effective length of the movable portion of member 50 to provide a low spring constant member having extended life characteristics.

The movable member 50 is formed with a bend spaced below platform 35, the bend being somewhat less than 90°, in the order of 83½° so that leg 54 extends into the switch chamber with its free distal end spaced from the stationary contact. Member 50 is received between ribs 47 and is attached to body 32 above the platform. As shown, a single screw 80 securely mounts the arm to the body with the effective length of the movable arm extending from screw 80 being substantially greater than the diameter of the cylinder. It will be appreciated that arm 50 could be attached by other suitable means, such as a post section formed integrally with the body section and received through aperture 58 and staked over.

Figure 4:
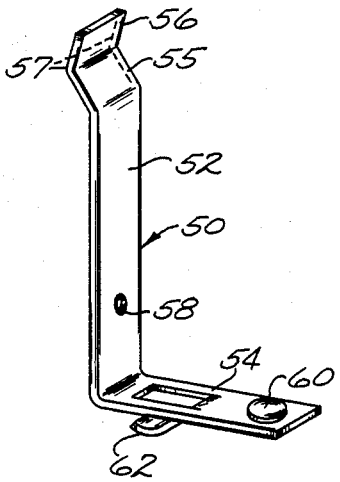
FIG. 4 is a perspective view of the movable contact arm shown in FIG. 1.

The tongue portion 62 is formed into a spherical shape so that a smooth surface engages disc 82 making calibration more consistent. Although movable member 50 is electrically connected to housing 12 through disc 82, it is preferred to form the distal end 52 into the "V" shape surface configuration discussed supra which can be grounded by firmly biasing it against the housing wall through edges 57 seen in FIG. 4.

Provision of the extended effective length of the movable contact arm to minimize material stress and spring constant results in a switch which, for the same performance characteristics is reduced in size. For example, the housing of a switch made in accordance with the invention was reduced from a hexagonal size of 0.75 inch to a hexagonal size of 0.56 inch, and the thread from $\frac{3}{8}$-18 NPT to $\frac{1}{4}$-18 NPT.

While the invention has been shown and described with reference to a particular embodiments thereof, it will be understood by those skilled in the art that changes in form and detail may be made without departing from the spirit and scope of the invention.

I claim:

1. A condition responsive switch comprising a cylindrical metallic housing having two opposite ends, one end being open and the second end having a disc seat formed thereat, an elongated body of electrically insulative material having a longitudinal axis and having at least a portion thereof telescopically received through and closing the open end of the housing, the body having a free distal end spaced a selected distance from the disc seat to form a switch chamber, a slot extending through the body parallel to the longitudinal axis, aterminal member received in the slot and extending from a point outside the housing to a point within the switch chamber, a stationary contact mounted on the terminal member disposed in the switch chamber, a generally flat surface formed on the outer peripheral surface of the body extending parallel to the longitudinal axis over a major portion of the length of the portion of the body received in the housing, a generally "L" shaped movable contact member of good electrically conductive material having good spring characteristics, the member having a first leg received on the flat surface and attached to the body, the first leg having a free distal end portion bent into "V" shaped converging surfaces, the "V" shaped portion biased into electrical engagement with the internal housing wall, the "L" shaped member having a second leg extending transversely across the switch cavity, a movable contact mounted on the free distal portion of the second leg adapted to move into and out of engagement with the stationary contact, a tongue struck from the second leg and bent downwardly toward the disc seat and a snap acting disc received on the disc seat and movable between concave and convex positions upon the occurrence of selected conditions to cause the movable contact, through the tongue of the movable contact member to move into and out of engagement with the stationary contact.

2. A condition responsive switch according to claim 1 in which the first leg is affixed to the body at a point axially removed from the distal end of the body to increase the effective length of the movable contact member.

3. A condition responsive switch according to claim 1 in which the second leg is spaced from the distal end of the body to increase the effective length of the movable contact member.

4. A condition responsive switch according to claim 2 in which the second leg is spaced from the distal end of the body to increase the effective length of the movable contact member.

5. A condition responsive switch according to claim 1 in which the disc engaging distal free end of the tongue is formed into a generally spherical portion configuration.

6. A condition responsive switch comprising a cylindrical metallic housing having two opposite ends, one end being open and the second end having a disc seat formed thereat, an elongated body of electrically insulative material having a longitudinal axis and having at least a portion thereof telescopically received through and closing the open end of the housing, the body having a free distal end spaced a selected distance from the disc seat to form a switch chamber, a slot extending through the body parallel to the longitudinal axis, a terminal member received in the slot and extending from a point outside the housing to a point within the switch chamber, a stationary contact mounted on the terminal member disposed in the switch chamber, a generally flat surface formed on the outer peripheral surface of the body extending parallel to the longitudinal axis, a generally "L" shaped movable contact member of good electrically conductive material having good spring characteristics, the member having a first leg received on the flat surface and attached to the body and a second leg extending transversely across the switch cavity, a movable contact mounted on the free distal portion of the second leg adapted to move into and out of engagement with the stationary contact, a tongue struck from the second leg and bent downwardly toward the disc seat and a snap acting disc received on the disc seat and movable between concave and convex positions upon the occurrence of selected conditions to cause the movable contact, through the tongue of the movable contact member to move into and out of engagement with the stationary contact, the slot extending through the body being configured such that a plane perpendicular to the longitudinal axis intersects the slot in a rectangle having a width substantially greater than its thickness, the plane intersecting the housing forming a circular section with a first diameter of the circular section parallel to the width and the greater portion of the slot disposed on one side of a second diameter of the circular section, the first and second diameter being 90° relative to one another and the width of the slot being skewed relative to the flat seating surface whereby the transverse length of the movable contact member is maximized.

7. A switch made in accordance with claim 6 in which the first leg of the movable contact member has a free distal end portion which is bent out of the plane in which the remainder of the first leg lies, the free distal end wedged against the inside surface of the housing.

8. A switch made in accordance with claim 7 in which the first leg of the movable contact member is attached to the body by a screw member located between the distal free end portion and the second leg.

* * * * *